United States Patent [19]

Theurer et al.

[11] Patent Number: 4,635,664

[45] Date of Patent: Jan. 13, 1987

[54] MOBILE BALLAST CLEANING MACHINE

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[21] Appl. No.: 660,691

[22] Filed: Oct. 15, 1984

[30] Foreign Application Priority Data

Jan. 19, 1984 [AT] Austria ..... 182/84

[51] Int. Cl.[4] ..... B08B 3/04

[52] U.S. Cl. ..... 134/131; 134/127; 134/133; 37/107

[58] Field of Search ..... 134/61, 68, 73, 104, 134/110, 127, 131, 133; 171/17; 37/104, 105, 106, 107; 209/173; 210/389; 56/16.4, 16.5, 16.6, 328

[56] References Cited

U.S. PATENT DOCUMENTS

| | | | |
|---|---|---|---|
| 945,692 | 1/1910 | Campbell | 209/173 |
| 2,139,047 | 12/1938 | Tromp | 209/173 X |
| 2,196,451 | 4/1940 | Holzer | 209/173 X |
| 2,616,564 | 11/1952 | Schrock | 171/17 |
| 2,775,438 | 12/1956 | Bach et al. | 37/104 X |
| 2,884,742 | 5/1959 | Moore et al. | 171/17 X |
| 3,316,666 | 5/1967 | Speno | 37/107 |
| 3,625,290 | 12/1971 | Johnson | 171/17 |
| 4,267,777 | 5/1981 | Theurer et al. | 37/104 X |
| 4,284,009 | 8/1981 | Theurer et al. | 37/104 X |
| 4,355,433 | 10/1982 | Dietrich | 56/328 R |

FOREIGN PATENT DOCUMENTS

| | | |
|---|---|---|
| 531681 | 9/1931 | Fed. Rep. of Germany . |
| 1519316 | 7/1978 | United Kingdom . |

*Primary Examiner*—Harvey C. Hornsby
*Assistant Examiner*—Frankie L. Stinson
*Attorney, Agent, or Firm*—Kurt Kelman

[57] ABSTRACT

A mobile cleaning ballast machine comprises an elongated machine frame; an endless ballast excavating and conveying chain adjustably mounted on the machine frame; and a ballast screening installation arranged to receive the excavated ballast conveyed by the endless chain. The excavated ballast is washed in an apparatus comprising an elongated conveyor receiving the excavated ballast conveyed by the endless chain and conveying the received ballast in a conveying path to the ballast screening installation, a water tank mounted on the machine frame below the elongated conveyor, the elongated conveyor extending above the water tank and the screening installation, a series of nozzles directed towards the conveying path and receiving water from the tank, and a drainage sieve for returning the water from the elongated conveyor to the water tank.

8 Claims, 4 Drawing Figures

MOBILE BALLAST CLEANING MACHINE

The present invention relates to a mobile machine for cleaning ballast supporting a railroad track, which comprises an elongated machine frame, an endless ballast excavating and conveying chain adjustably mounted on the machine frame, a ballast screening installation arranged to receive the excavated ballast conveyed by the endless chain, and apparatus for washing the excavated ballast conveyed by the endless chain.

Railroad track ballast beds must be cleaned from time to time to remove encrustations and thus to restore the elastic support and the stability of the track. Where the subgrade on which the ballast supports the track ties comprises relatively soft clay or sludge which is resistant to proper drainage, the subgrade material tends to rise into the empty spaces between the ballast stones, thus coating the ballast with the subgrade material. In such track sections, the track position is particularly unstable and, therefore, must be corrected frequently. When such ballast is excavated and cleaned on conventional screening installations used in mobile ballast cleaning machines, only a portion of the waste can be removed from the ballast by screening while the sludge or clay adhering to the surfaces of the ballast stones is returned with the screened ballast to form the restored ballast bed. Therefore, screening alone cannot satisfactorily clean this type of dirty ballast.

British Pat. No. 1,519,316, published July 26, 1978, discloses a mobile ballast cleaning machine of the first-described type, whose ballast washing apparatus comprises a water tank moving with the machine and water-spraying nozzles to which water is pumped from the tank. The nozzles are capable of wetting the ballast stones with water, to remove the waste adhering to the surfaces of the ballast stones and to wash the ballast stones, and they are arranged in the conveyor trough guiding the lower stringer of the ballast conveying chain and in the range of the screening installation. The mobile water tank trails the ballast cleaning machine in the operating direction of the machine and high-pressure conduits connect the water pump to the nozzles to deliver high-pressure sprays. Such a machine has not been commercially used up to date because the relatively large water requirements make it uneconomical.

German Pat. No. 531,681 discloses apparatus for cleaning ballast by sifting and washing, which comprises a water drum, a sand receptacle and a water cleaning device. This apparatus also includes a water tank to be moved therewith and is relatively voluminous and heavy. This apparatus, too, has not been commercially used since it is not properly connected to the non-stop advancing ballast cleaning machine and does not enable the excavated ballast to be washed in an economical manner.

It is the primary object of this invention to provide an economical mobile machine for cleaning ballast supporting a railroad track, which includes apparatus for washing the excavated ballast free of dirt by rapidly detaching the dirt from the ballast stones.

The above and other objects are accomplished according to the invention with a washing apparatus which comprises an elongated conveyor receiving the excavated ballast conveyed by the endless chain and conveying the received ballast in a conveying path to the ballast screening installation, a water tank mounted on the machine frame below the elongated conveyor, the elongated conveyor extending above the water tank and the screening installation, a series of nozzles directed towards the conveying path and receiving water from the tank, and a drainage sieve for returning the water from the elongated conveyor to the water tank.

This apparatus for the first time provides an economically feasible mobile ballast cleaning machine capable of washing the ballast with water moving in a substantially closed circuit. At the same time, the ballast is sufficiently cleaned, the adhering dirt being removed from the excavated ballast to a large extent before the ballast reaches the screening installation. This takes a load off the screening installation and correspondingly increases its cleaning capacity. The washing apparatus is constituted by a relatively simple structure and existing mobile ballast cleaning machines may be readily retrofitted with such an apparatus without in any way interfering with the conventional operation of such machines. It has the further advantage that the water delivery may be stopped at any time so that the machine may be operated conventionally without washing the ballast before it is cleaned on the screening installation.

The above and other objects, advantages and features of the present invention will become more apparent from the following detailed description of certain now preferred embodiments thereof, taken in conjunction with the accompanying, somewhat schematic drawing wherein FIG. 1 is a side elevational view of a mobile ballast cleaning machine for handling shoulder ballast according to one embodiment of this invention;

Figure 1:
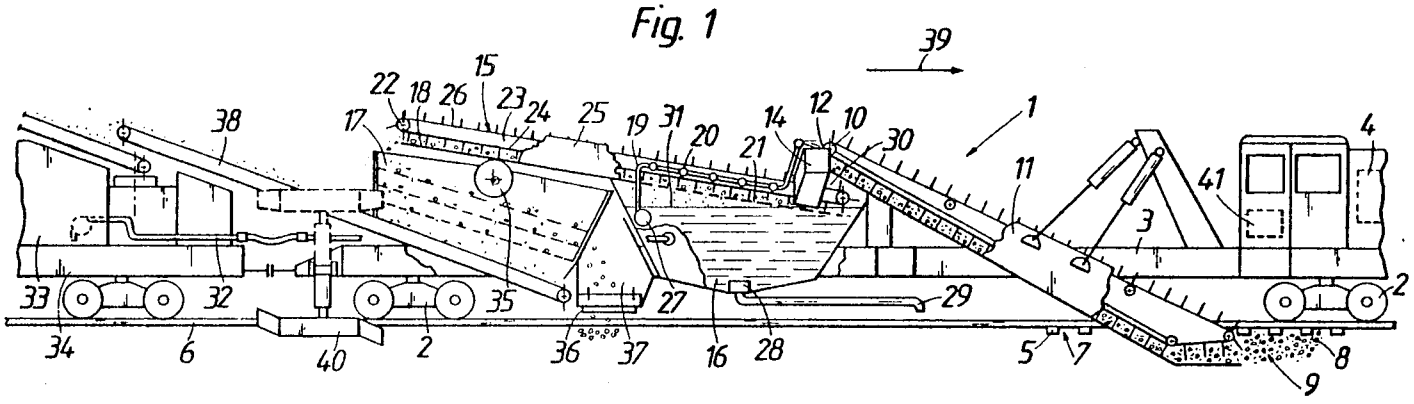
Figure 2:
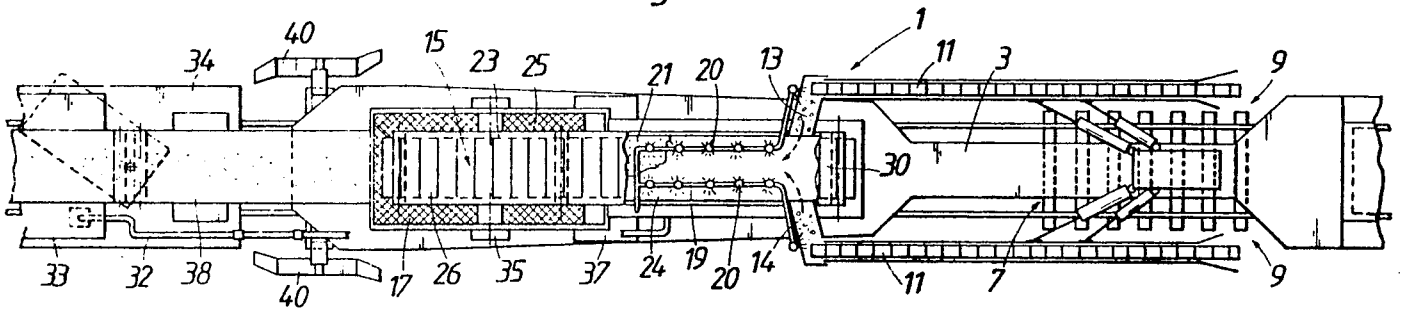
FIG. 2 is a top view of the machine of FIG. 1.

Referring now to the drawing and first to FIGS. 1 and 2, there is shown mobile machine 1 for cleaning ballast 8 from shoulders 9 of a ballast bed supporting railroad track 7 consisting of rails 6 fastened to ties 5. The machine comprises elongated machine frame 3 supported on undercarriages 2, 2 for mobility along the track in an operating direction indicated by arrow 39. The machine frame carries an operator's cab and adjacent power plant 4 supplying energy for driving the machine and operating the same. Respective endless ballast excavating and conveying chain 11 is arranged at opposite sides of machine frame 3 for excavating ballast 8 from shoulders 9 of the railroad track. Each ballast excavating and conveying chain 11 is independently adjustably mounted on machine frame 3 and is arranged to be driven by drive 10 independently of each other in a substantially vertical plane extending in the direction of elongation of machine frame 3.

Ballast screening installation 17 is arranged to receive the excavated ballast conveyed by the endless chains, and an apparatus for washing the excavated ballast conveyed by the endless chains comprises elongated conveyor 15 receiving the excavated ballast conveyed by endless chains 11 and conveying the received ballast in conveying path 18 to ballast screening installation 17, water tank 16 mounted on machine frame 3 below elongated conveyor 15, the elongated conveyor extending above the water tank and the ballast screening installation, a series of nozzles 20 directed towards the conveying path and receiving water from tank 16, and drainage means 21 for returning the water from the elongated conveyor to the water tank. Each ballast excavating and conveying chain has a discharge end 12 adjacent elongated conveyor 15 and the illustrated drainage means comprises a sieve defining drainage openings 21.

In the embodiment of FIGS. 1 and 2, respective ballast conveying chute 13, 14 extends transversely to the direction of elongation of machine frame 3 and is arranged to receive the excavated ballast from discharge end 12 of respective ballast excavating and conveying chain 11, and to convey the ballast to centrally positioned elongated conveyor 15.

This construction incorporating the basic principles of the ballast cleaning machine of the present invention provides a qualitatively improved and more efficient cleaning of shoulder ballast. Since the two endless ballast excavating and conveying chains are independently adjustable and driven, each one may be optimally vertically positioned and/or driven at different speeds to adapt the respective chain to ballast shoulders of different depths.

The illustrated elongated conveyor is an endless bucket chain conveyor 23 having an upper stringer 26 and a lower stringer 24. U-shaped trough 25 has a bottom and an open top, a portion of the trough bottom being constituted by drainage sieve 21. Nozzles 20 deliver water from tank 16 into trough 25, and lower stringer 24 of endless bucket chain conveyor 23 is guided in, and through, trough 25. The endless bucket chain conveyor is arranged to ascend towards screening installation 17, and nozzles 20 and sieve 21 extend only over an elongated section of the endless bucket chain conveyor arranged above water tank 16. As shown in the drawing, nozzles 20 are arrayed in two parallel elongated rows between stringers 24 and 26 of endless bucket chain conveyor 23. High pressure pump 27 is arranged in an upper part of water tank 16 and common main 19 connects the high pressure pump to the nozzles. Sludge pump 28 is arranged in water tank 16 close to the bottom thereof, and drainage pipe 29 is connected thereto and is arranged to receive the sludge that has settled at the bottom of the tank.

This arrangement enables the dirty ballast stones to be thoroughly washed and rinsed in the U-shaped trough and assures the rapid discharge of the dirty wash water from the trough through openings 21. The endless bucket chain conveyor has a high conveying capacity and permits the excavated ballast to be deposited on the bottom of the trough and to be frictionally engaged by the moving buckets to be agitated and turned around for added exposure to the wash water. Where the nozzles and drainage openings extend only over a section of the ascending conveyor above the water tank, the dirt from the ballast stones will be removed from the trough along the shortest possible path without requiring additional means for such sludge or waste removal. In addition, the wash water will run off before the washed ballast will reach the screening installation.

The indicated nozzle arrangement makes it possible to dispose the nozzles very close to the conveyed ballast so that the ballast may be subjected to a high-intensity spray by the water delivered to the nozzles under high pressure without interfering with the operation of the elongated conveyor. The sludge settled in the tank is constantly removed at the bottom so that the high pressure pump in the upper part of the water tank will always deliver substantially clean water, regardless of the degree of encrustation of the ballast.

Storage tank 33 for storing water is mounted on freight car 34 coupled to machine frame 3 of the ballast cleaning machine and moving therewith, water delivery conduit 32 being arranged to deliver stored water from storage tank 33 to water tank 16 whereby the water in the water tank may be maintained at substantially constant level 31. Elongated conveyor 15 has input end 30 adjacent endless ballast excavating and conveying chains 11. The input end of the conveyor is disposed at least partially below water level 31. In this manner, the excavated ballast is submerged in water and wetted at the input end before cleansing by the water sprays from nozzles 20 begins. The encrusted dirt on the ballast stones absorbs the water at the conveyor input end and is thereby softened to make cleansing by the subsequent water spray nozzles even more effective. Any water loss encountered by the sludge removal at the bottom of tank 16 is compensated continuously by the delivery of stored water from tank 33, thus assuring a uniform quality of cleansing throughout the operation.

As illustrated, chute arrangement 37 with controllable ballast outlet means 36 is arranged between water tank 16 and screening installation 17, the chute, arrangement receiving the washed and cleaned ballast from the screening installation for redistribution of the ballast to the track shoulders through the outlet means. As is well known, vibrating drive 35 imparts vibrations to the screens of the screening installation to enhance the screening effect thereof. The outlet means for the washed and cleaned ballast may be so controlled that the redistribution of the ballast will produce uniform track shoulders, the space beneath the water tank remaining free to collect the sludge.

The machine further comprises conveyor means 38 for removing waste received from screening installation 17. Also, vertically adjustable shoulder plows 40 are mounted at the rear end of machine frame 3, as seen in the operating direction of the machine, to enable the redistributed ballast to be suitably shaped. The shoulder plows may be pivoted into a rest position (shown in broken lines in FIG. 1) about an axis extending in the direction of elongation of the machine frame. All the drives of machine 1 are operated by central control 41 in the operator's cab.

Figure 3:
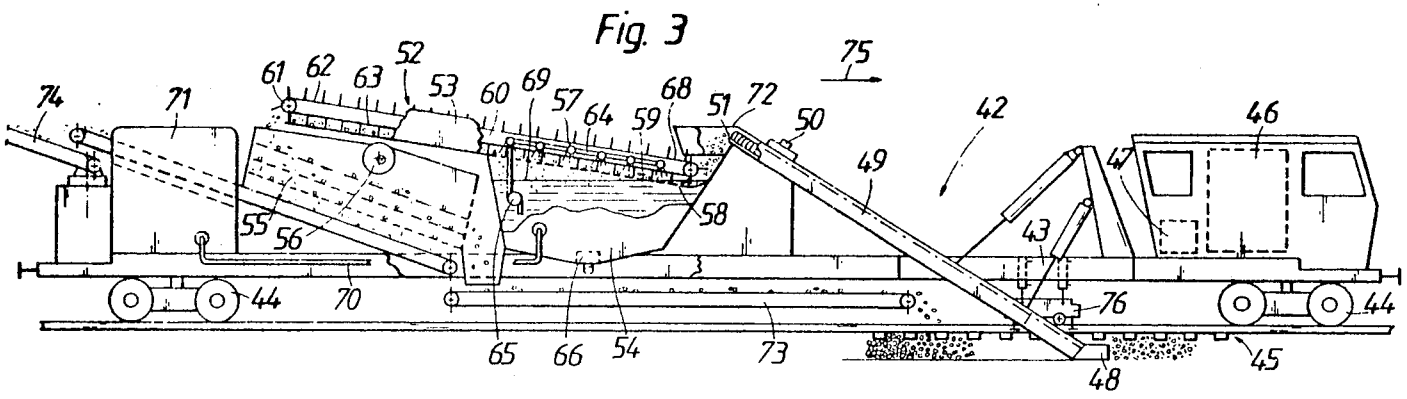
FIG. 3 is a side elevational view of a mobile ballast cleaning machine for handling the ballast of the entire ballast bed according to another embodiment of the invention.
Figure 4:
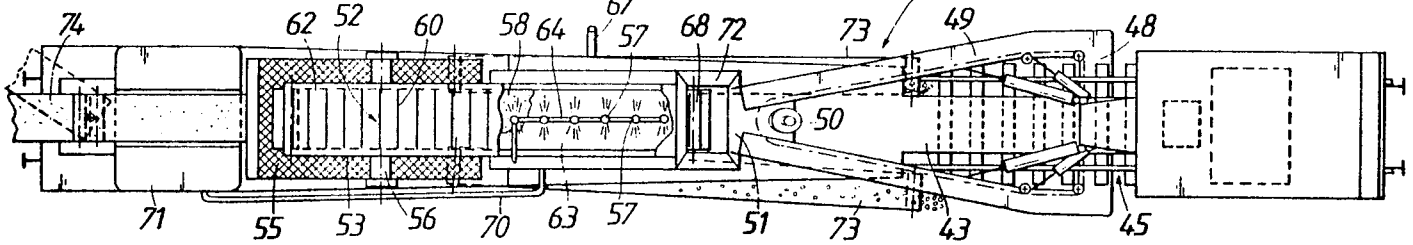
FIG. 4 is a top view of the machine of FIG. 3.

Mobile ballast cleaning machine 42 shown in FIGS. 3 and 4 is designed for excavating, washing and sifting the ballast from an entire bed underneath track 45. The machine comprises elongated machine frame 43 supported on undercarriages 44, 44 for mobility in an operating direction indicated by arrow 75. The machine frame carries power plant 46 and central control 47 for driving and operating the machine. Ballast excavating and conveying chain 49 comprises a polygonal endless guide and transverse stringer 48 to excavate the ballast supporting track 45. Endless chain 49 is driven by drive 50 and has discharge end 51 opposite transverse excavating stringer 48 extending below the track. Endless chain conveyor discharge end 51 is adjacent elongated conveyor 52 of the washing apparatus. Ballast conveying chute 72 is arranged to receive the excavated ballast from discharge end 51 of ballast excavating and conveying chain 49, and to convey the ballast to elongated conveyor 52. With such a machine, the entire ballast may be excavated over the entire width of the ballast while the machine advances continuously along the track and the excavated ballast is subjected to a thorough washing and cleaning. Since the washing of the ballast stones before their sifting relieves the screening installation of some cleansing work, the capacity of the machine is correspondingly increased and the maintenance work time between passing trains may be accordingly reduced.

The elongated conveyor 52 is disposed in U-shaped trough 53 above water tank 54 and screening installation 55 vibrated by drive 56. A single row of nozzles 57 directs water sprays towards the conveying path and the wash water is drained off through openings 58, the nozzles and the drainage openings extending only over elongated section 59 of ascending elongated conveyor 52 above water tank 54. The elongated conveyor is constituted by endless bucket chain conveyor 60 driven by drive 61 and comprising upper stringer 62 and lower stringer 63, the row of nozzles extending between the stringers and being connected by main 64 to high pressure pump 65 while sludge pump 66 removes the settled dirt or sludge from the bottom of tank 54 through discharge pipe 67 which may be laterally pivoted.

Input end 68 of endless bucket chain conveyor 60 is disposed below water level 69 which may be maintained substantially constant by delivering water through delivery conduit 70 from storage tank 71, all of the structural features of the washing apparatus having been described in detail in connection with FIGS. 1 and 2.

Nozzles 57 may be selectively operated as spray nozzles, wetting nozzles, dirt stripping nozzles or wash nozzles, which may also be connected to a supply of steam for blasting the ballast with steam. The selective use of such nozzles will enable the apparatus to serve for stripping even hardened encrustations from the ballast stones by applying thin but very intense water sprays thereto or cleansing relatively clean ballast stones by applying merely light sprays for merely wetting the stones.

In a generally conventional manner, mobile ballast cleaning machine 42 further comprises conveyor means 74 for removing waste from screening installation 55, on the one hand, and conveyor means 73 for distributing the washed and cleaned ballast received from the screening installation, on the other hand. Conveyor means 73 comprises two laterally pivotal conveyors having discharge ends sweeping over the width of the ballast bed for distributing the ballast thereover. Track lifting unit 76 is mounted on machine frame 43 for lifting track 75 in the range of transverse ballast excavating stringer 48. Thus, the washing apparatus with its water tank 54 will not interfere with the normal operation of the ballast cleaning machine, including the removal of the waste and the redistribution of the cleaned ballast.

The operation of the mobile ballast cleaning machine of this invention will partly be obvious from the above description of its structure and will be more fully explained hereinafter.

The two ballast excavating and conveying chains 11 or chain 49 are adjusted to the desired excavating level and continuously driven while the machine is continuously advanced in the operating direction to excavate the ballast and to convey it to discharge end 12 or discharge end 51 whence the excavated ballast is conveyed by chutes 13, 14 or chute 72 to the input end of elongated conveyor 15 or 52. Since the input end is below the water level in tank 16 or 54, the ballast stones are wetted and encrustations thereon are softened and thereby loosened. The buckets of endless bucket chain conveyor 23 or 60 extend transversely to the direction of elongation of the conveyor and seize the wetted ballast stones for conveyance through ascending trough 25 or 53 where nozzles 20 or 57 remove adhering dirt or sludge from the ballast and drain it through drainage openings 21 or 58 for return to the water tank. The sludge settles at the bottom of the tank and is pumped away when it reaches a predetermined depth determined by the level of the input of the sludge pump. The drainage pipe connected to the output of the sludge pump enables the sludge to be deposited at the side of the ballast bed. Any water loss from the water tank is compensated by delivering additional water from storage tank 33 or 71 to keep water level 31 or 69 substantially constant in the water tank. In this manner, a substantially closed water flow cycle is established with a minimum loss of wash water.

The washed ballast is conveyed by the ascending elongated conveyor to the screening installation which receives the washed ballast therefrom and subjects it to a sifting process. The resultant waste is removed from the screening installation by conveyor means 38 or 74 which conventionally comprises a series of elongated conveyors removing the waste to freight cars coupled to the machine or to the sides along the track bed whence it is removed by trucks. The cleaned ballast is redistributed in a conventional manner through controlled outlet means 36 and/or conveyor means 73. In the operation of machine 1, plows 40 are lowered into an operating position to shape the ballast shoulders and to compact them to a uniform density.

What is claimed is:

1. A mobile machine for cleaning ballast supporting a railroad track, which comprises (a) an elongated machine frame;

(b) an endless ballast excavating and conveying chain adjustably mounted on the machine frame;

(c) a ballast screening installation arranged to receive the excavated ballast conveyed by the endless chain; and (d) apparatus for washing the excavated ballast conveyed by the endless chain, the washing apparatus comprising (1) an elongated conveyor having an input end adjacent the endless ballast excavating and conveying chain and receiving the excavated ballast conveyed by the endless chain and conveying the received ballast in a conveying path to the ballast screening installation, (2) a water tank mounted on the machine frame below the elongated conveyor, the elongated conveyor extending above the water tank and the screening installation, (3) a series of nozzles directed towards the conveying path and receiving water from the tank, (4) drainage means comprising a sieve defining drainage openings for returning the water from the elongated conveyor to the water tank, (5) a trough having a bottom and an open top, a portion of the bottom of the trough being constituted by the sieve, the nozzles delivering water from the tank into the trough, the entire elongated conveyor being guided in, and through, the trough, the trough and the elongated conveyor extending above the water tank and the ballast screening installation, and the bottom portion of the sieve extending over the water tank, (6) a storage tank for storing water, and (7) a water delivery conduit arranged to deliver stored water from the storage tank to the water tank whereby the water in the water tank may be maintained at a substantially constant level, the input end of the elongated conveyor being disposed at least partially below the water level.

2. The mobile ballast cleaning machine of claim 1, wherein the elongated conveyor is an endless bucket chain conveyor having an upper and a lower stringer, having a bottom and an open top, at least a portion of the bottom of the trou9h being constituted by the sieve, the nozzles delivering water from the tank into the trough, and the lower stringer of the endless bucket chain conveyor being guided in, and through, the trough.

3. The mobile ballast cleaning machine of claim 2, wherein endless bucket chain conveyor is arranged to ascend towards the screening installation, and the nozzles and the sieve extend only over an elongated section of the endless bucket chain conveyor arranged above the water tank.

4. The mobile ballast cleaning machine of claim 2, wherein the nozzles are arrayed in at least one elongated row between the stringers of the endless bucket chain conveyor, and further comprising a high pressure pump arranged in an upper part of the water tank, a common main connecting the high pressure pump to the nozzles, a sludge pump arranged in the water tank close to the bottom thereof, and a drainage pipe connected thereto and arranged to receive the sludge therefrom.

5. The mobile ballast cleaning machine of claim 1, wherein a respective one of said ballast excavating and conveying chains is arranged at opposite sides of the machine frame for excavating ballast from the shoulders of the railroad track, each one of the ballast excavating and conveying chains being independently adjustable on the machine frame, being arranged to be driven independently of each other in a substantially vertical plane extending in the direction of elongation of the machine frame, and having a ballast discharge end adjacent the elongated conveyor, and further comprising a respective ballast conveying chute extending transversely to said direction and arranged to receive the excavated ballast from the discharge end of the respective ballast excavating and conveying chain, and to convey the ballast to the elongated conveyor.

6. The mobile ballast cleaning machine of claim 1, further comprising a chute arrangement with controllable ballast outlet means arranged between the water tank and the screening installation, the chute arrangement receiving the washed and cleaned ballast from the screening installation for redistribution through the outlet means.

7. The mobile ballast cleaning machine of claim 1, wherein the ballast excavating and conveying chain comprises a polygonal endless guide and a transverse stringer arranged to excavate the ballast supporting the track, the endless ballast excavating and conveying chain having a discharge end opposite the transverse excavating stringer and adjacent the endless conveyor, and further comprising a ballast conveying chute arranged to receive the excavated ballast from the discharge end of the ballast excavating and conveying chain, and to convey the ballast to the elongated conveyor.

8. The mobile ballast cleaning machine of claim 1, further comprising conveyor means for removing waste received from the screeening installation, on the one hand, and means for distributing the washed and cleaned ballast received from the screening installation, on the other hand.

* * * * *